US009448020B1

(12) United States Patent
Olson

(10) Patent No.: US 9,448,020 B1
(45) Date of Patent: Sep. 20, 2016

(54) BARREL EXTENSION AND BOLT CARRIER SYSTEM

(71) Applicant: Innovative Tool and Advanced Weapon Solutions, LLC, Easton, CT (US)

(72) Inventor: Clifford W. Olson, Easton, CT (US)

(73) Assignee: Innovative Tool and Advanced Weapon Solutions, LLC, Easton, CT (US)

( * ) Notice: Subject to any disclaimer, the term of this patent is extended or adjusted under 35 U.S.C. 154(b) by 0 days.

(21) Appl. No.: 14/958,289

(22) Filed: Dec. 3, 2015

Related U.S. Application Data

(63) Continuation of application No. 13/923,561, filed on Jun. 21, 2013, now Pat. No. 9,234,713, which is a continuation-in-part of application No. 13/548,168, filed on Jul. 12, 2012, now Pat. No. 8,966,800, and a (Continued)

(51) Int. Cl.
*F41A 3/30* (2006.01)
*F41A 3/66* (2006.01)

(52) U.S. Cl.
CPC ... *F41A 3/30* (2013.01); *F41A 3/66* (2013.01)

(58) Field of Classification Search
CPC ..... F41A 3/66; F41A 21/48; F41A 21/482; F41A 3/30
USPC ..... 42/75.02
See application file for complete search history.

(56) References Cited

U.S. PATENT DOCUMENTS

| | | | |
|---|---|---|---|
| 467,180 | A | 1/1892 | Mauser |
| 2,198,610 | A | 4/1940 | Garand |
| 2,655,837 | A | 10/1953 | Johnson |
| 3,253,362 | A | 5/1966 | Gitchell |
| 3,411,405 | A | 11/1968 | Pachmayr et al. |
| 3,780,618 | A | 12/1973 | Sanford |
| 4,169,329 | A | 10/1979 | Atchisson |
| 4,269,108 | A | 5/1981 | Stoner |
| 4,272,902 | A | 6/1981 | Waters |
| 5,351,598 | A | 10/1994 | Schuetz |

(Continued)

FOREIGN PATENT DOCUMENTS

| | | |
|---|---|---|
| DE | 3038769 | 12/1988 |
| EP | 0190456 | 5/1988 |

(Continued)

OTHER PUBLICATIONS

Notice of Allowance in U.S. Appl. No. 13/548,168 mailed on Oct. 28, 2014 (5 pps.).

(Continued)

*Primary Examiner* — Stephen M Johnson
(74) *Attorney, Agent, or Firm* — Carson C. K. Fincham; Fincham Downs, LLC

(57) ABSTRACT

Systems, methods, and articles of manufacture for repeating and semi-automatic cone-breech firearm systems, including barrel extension and bolt carrier systems, are provided. A semi-automatic cone-breech firearm system may, for example, comprise a tapered semi-automatic seven (7) or eight (8) lug bolt having a cartridge channel that facilitates engagement of an ammunition cartridge with a cartridge seat and/or a plunger-style ejector and may comprise a barrel extension and mating bolt carrier for housing and accepting the bolt.

20 Claims, 11 Drawing Sheets

Related U.S. Application Data continuation-in-part of application No. 13/548,171, filed on Jul. 12, 2012, now Pat. No. 9,038,303.

(60) Provisional application No. 61/690,442, filed on Jun. 27, 2012, provisional application No. 61/690,443, filed on Jun. 27, 2012, provisional application No. 61/690,864, filed on Jul. 6, 2012, provisional application No. 61/743,194, filed on Aug. 29, 2012, provisional application No. 61/743,195, filed on Aug. 29, 2012, provisional application No. 61/795,702, filed on Oct. 23, 2012, provisional application No. 61/848,257, filed on Dec. 28, 2012, provisional application No. 61/851,272, filed on Mar. 6, 2013, provisional application No. 61/837,239, filed on Jun. 20, 2013.

(56) References Cited

U.S. PATENT DOCUMENTS

| | | | | |
|---|---|---|---|---|
| 5,520,019 | A | 5/1996 | Schuetz | |
| 5,794,373 | A | 8/1998 | Moon | |
| 6,182,389 | B1 * | 2/2001 | Lewis | F41A 3/26 42/16 |
| 6,536,150 | B2 | 3/2003 | Schweikart | |
| 6,609,319 | B1 * | 8/2003 | Olson | F41A 3/26 42/16 |
| 6,978,709 | B2 | 12/2005 | Aalto et al. | |
| 7,735,410 | B2 | 6/2010 | Clark | |
| D641,451 | S | 7/2011 | Gomez et al. | |
| 8,069,600 | B2 | 12/2011 | Rousseau et al. | |
| 8,087,194 | B1 | 1/2012 | Vuksanovich | |
| 8,161,864 | B1 | 4/2012 | Vuksanovich | |
| 8,307,750 | B2 | 11/2012 | Vuksanovich et al. | |
| 8,387,513 | B2 | 3/2013 | Gomez et al. | |
| 2002/0073591 | A1 | 6/2002 | Schweikart | |
| 2006/0185212 | A1 | 8/2006 | Curry et al. | |
| 2012/0131835 | A1 * | 5/2012 | Barrett | F41A 3/26 42/75.02 |
| 2012/0311908 | A1 * | 12/2012 | Kenney | F41A 21/485 42/75.02 |

FOREIGN PATENT DOCUMENTS

| | | |
|---|---|---|
| FR | 371495 | 3/1907 |
| GB | 25383 | 0/1913 |

OTHER PUBLICATIONS

Notice of Allowance in U.S. Appl. No. 13/548,171 mailed on Jan. 20, 2015 (7 pps.).
Office Action in U.S. Appl. No. 13/923,561 mailed on Mar. 20, 2014 (10 pps.).
Final Office Action in U.S. Appl. No. 13/923,561 mailed on Aug. 22, 2014 (8 pps.).
Notice of Allowance in U.S. Appl. No. 13/923,561 mailed on Sep. 4, 2015 (7 pps.).
Office Action in U.S. Appl. No. 13/923,561 mailed on Feb. 20, 2015 (6 pps.).

* cited by examiner

BARREL EXTENSION AND BOLT CARRIER SYSTEM

CROSS-REFERENCE TO RELATED APPLICATIONS

The present application is Continuation of, and claims benefit and priority under 35 U.S.C. §120 to U.S. patent application Ser. No. 13/923,561 filed on Jun. 21, 2013 and titled "SEMI-AUTOMATIC CARTRIDGE FEEDING SYSTEM", which issued as U.S. Pat. No. 9,234,713 on Jan. 12, 2016, and which itself:

(1) is a non-provisional of, and claims benefit and priority under 35 U.S.C. §119(e) to (i) U.S. Provisional Patent Application No. 61/690,442 filed on Jun. 27, 2012 and titled "AR15/M16 eight locking lug cone-breech-bolt cartridge feeding system", (ii) U.S. Provisional Patent Application No. 61/690,443 filed on Jun. 27, 2012 and titled "Eight locking-lug compatible ammunition extraction system", (iii) U.S. Provisional Patent Application No. 61/690,864 filed on Jul. 6, 2012 and titled "Full cone AR15/M16 barrel extension and mating bolt carrier system", (iv) U.S. Provisional Patent Application No. 61/743,194 filed on Aug. 29, 2012 and titled "Lengthened full cone AR15/M16 barrel extension and mating bolt carrier cartridge feeding system", (v) U.S. Provisional Patent Application No. 61/743,195 filed on Aug. 29, 2012 and titled "AR15/M16 seven lug cone breech bolt, extractor, and cartridge feeding system", (vi) U.S. Provisional Patent Application No. 61/795,702 filed on Oct. 23, 2012 and titled "Improved AR15/M16 bolt and wide claw extractors", (vii) U.S. Provisional Patent Application No. 61/848,257 filed on Dec. 28, 2012 and titled "Eight locking lug AR15/M16 bolt and wide body V shaped extractor", (viii) U.S. Provisional Patent Application No. 61/851,272 filed on Mar. 6, 2013 and titled "Lengthened full cone AR15/M16 barrel extension and mating bolt carrier cartridge feeding system", and (ix) U.S. Provisional Patent Application No. 61/837,239 filed on Jun. 20, 2013 and titled "CARTRIDGE FEEDING SYSTEM", the entirety of each of which is hereby incorporated by reference herein; and (2) is also a Continuation-In-Part (CIP) of, and claims benefit and priority under 35 U.S.C. §120 to (i) U.S. patent application Ser. No. 13/548,168 filed on Jul. 12, 2012 and titled "WIDE-FLANGED CARTRIDGE EXTRACTOR", which issued as U.S. Pat. No. 8,966,800 on Mar. 3, 2015, and (ii) U.S. patent application Ser. No. 13/548,171 filed on Jul. 12, 2012 and titled "REPEATING CONE-BREECH FIREARM SYSTEM", which issued as U.S. Pat. No. 9,038,303 on May 26, 2015, the entirety of each of which is hereby incorporated by reference herein.

BACKGROUND

Different types and/or styles of cartridge ejection mechanisms or "ejectors" are utilized in various types of firearms. Some are integral to the firearm bolt (e.g., a "plunger-style" ejector) while others are integral to the receiver assembly. While each available style provides differing benefits and drawbacks, many prefer the simplicity and bolt-integral nature and operating characteristics of the plunger-style ejector.

Most firearms utilize a bolt with a planar face that is designed to mate with a corresponding planar face of a breech, barrel extension, and/or firing chamber (e.g., to seal a cartridge in the chamber for firing). It is understood however, that a tapered or cone-shaped mating configuration is advantageous. Tapering the face of the bolt and providing a cone-shaped breech, for example, provides a less obstructive path for feeding cartridges into the firing chamber, provides for an increased surface contact mating area between the bolt and the breech, and/or permits decreased levels of cartridge case protrusion. These advantages allow for (i) more reliable cartridge feeding (e.g., less jamming and/or cartridge damage upon feeding), (ii) increased contact area that provides an enhanced seal that is less likely to result in blowback or structural failure, and (iii) increased cartridge case contact with the chamber that minimizes the likelihood of catastrophic cartridge failure, respectively.

Despite these recognized advantages, most firearms do not utilize a cone-shaped breech. This is primarily due to the fact that tapered bolt configurations capable of use in cone-shaped breech systems are not capable of functioning properly in repeating firearms, particularly in conjunction with a plunger-style ejector. In other words, magazine and clip-feed firearms that are designed to store and repeatedly load, fire, and eject cartridges in a repeating fashion are unable to benefit from the advantages of a cone-breech design, especially when combined with a plunger-style ejector, due to interference with cartridge loading.

Semi-automatic firearms suffer from other deficiencies inherent in their design and functionality. Semi-automatic firearm bolts with multiple locking lugs, such as those utilized in AR-15/M-16 models for example, sacrifice locking lug strength and/or integrity due to extractor design and configuration. The standard AR-15/M-16 bolt comprises seven (7) locking lugs, for example, such that forces acting upon the lugs due to firearm operation are distributed over each of the seven (7) lugs. While it is desirable to distribute the forces acting upon such locking lugs amongst more lugs and/or across more material (for increased strength and reliability), the necessity of the typical extractor requires that the material where an eighth ($8^{th}$) lug could be formed be removed. In an effort to mediate this deficiency, the standard extractor comprises a raised portion on the bolt-face end to simulate an eight ($8^{th}$) locking lug.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Figure 2A:
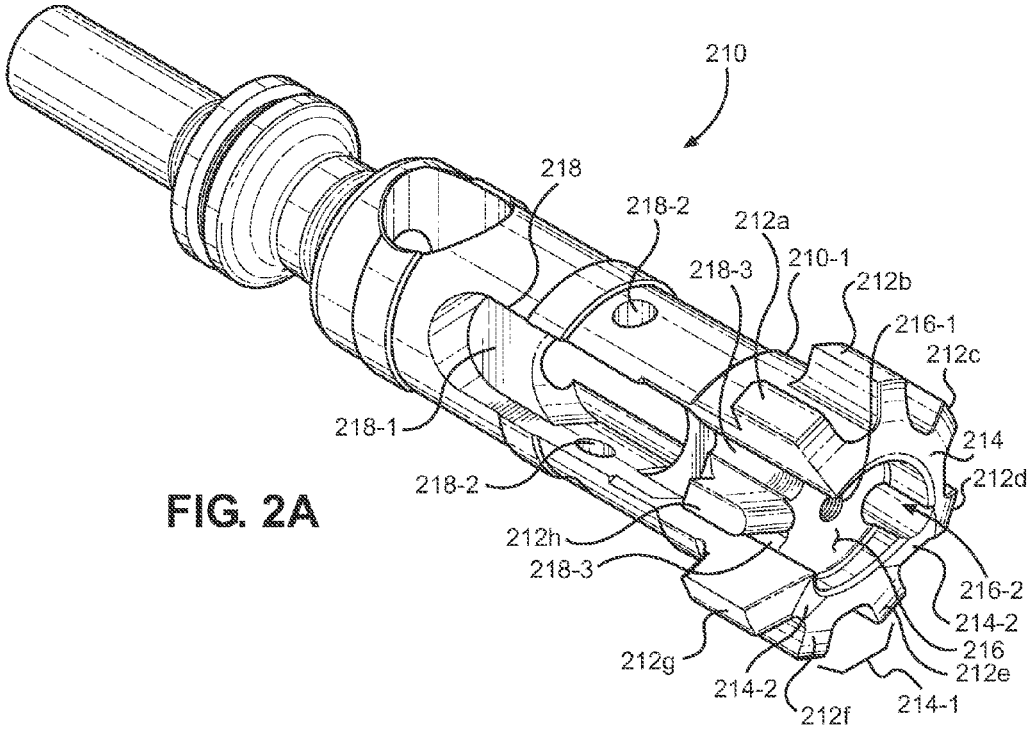
FIG. 2A, FIG. 2B, FIG. 2C, and FIG. 2D are perspective, side, top, and front views of a semi-automatic eight (8)-lug firearm bolt according to some embodiments.
Figure 2B:
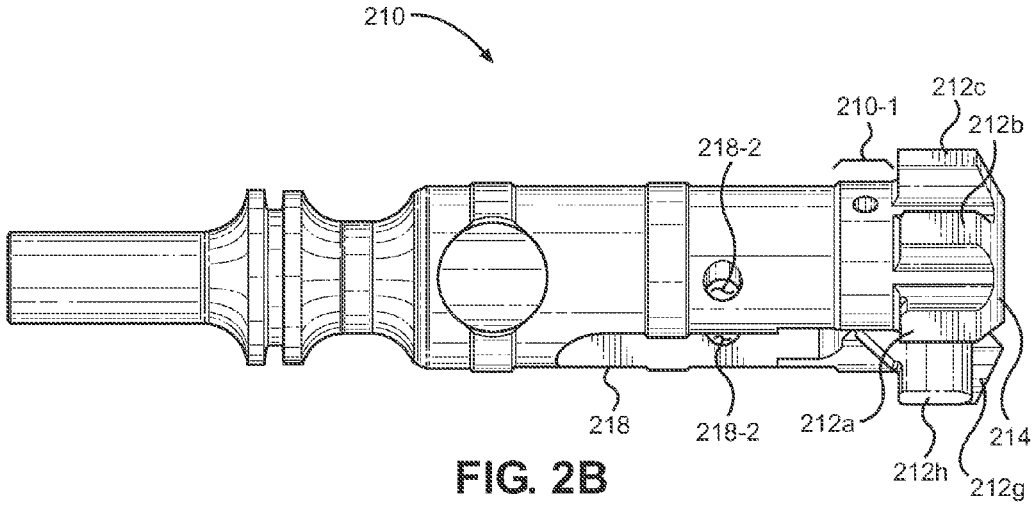
Figure 2C:
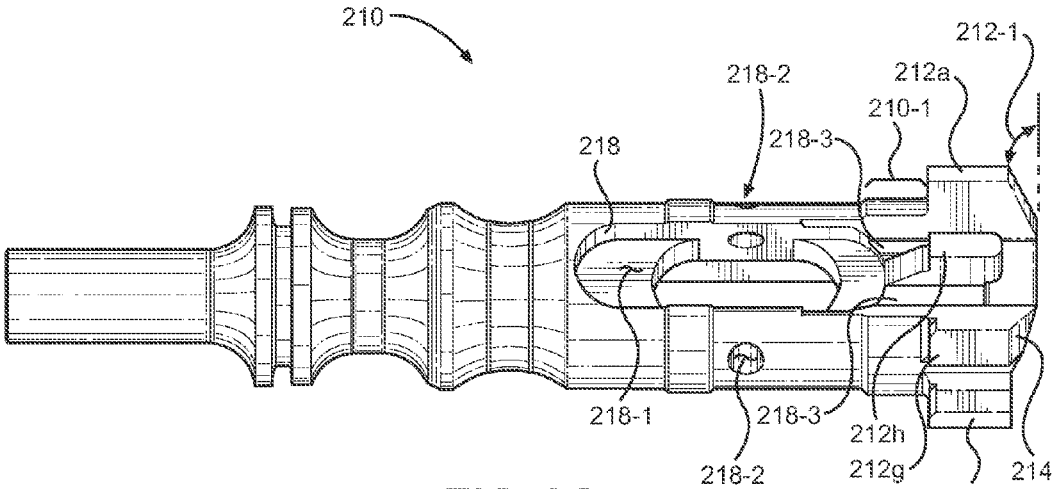

Embodiments presented herein are descriptive of systems, apparatus, methods, and articles of manufacture for firearm cartridge extractors that are operable to mate and/or function with an eight (8)-lug semi-automatic firearm bolt, a semi-automatic cone-breech bolt (e.g., seven (7)-lug and/or eight (8)-lug), and/or are or comprise a wide-flanged design (in some embodiments, for example, an engaging portion or "flange" of a firearm cartridge extractor is elongated in a transverse direction—i.e., a portion of the extractor configured to engage with a rim of an ammunition cartridge is elongated to contact a larger portion of the cartridge than a typical extractor). According to some embodiments, an extractor may be configured to fit over an eighth ($8^{th}$)-lug of an eight (8)-lug semi-automatic firearm bolt or between firearm bolt lugs (e.g., by utilizing a narrow-neck design). In some embodiments, an extractor may be configured to mate with semi-automatic bolt in such a manner as to minimize the amount of lug material required to be removed to accommodate the extractor (e.g., utilizing angled extractor sides and/or utilizing a narrow-neck extractor). For non-limiting purposes of illustration and comparison, the configuration of some typical ammunition extractors is generally described with respect to FIG. 2A and FIG. 2B of co-pending U.S. patent application Ser. No. 13/548,168 filed on Jul. 12, 2012 and titled "WIDE-FLANGED CARTRIDGE EXTRACTOR", incorporated by reference herein.

Embodiments presented herein are also descriptive of systems, apparatus, methods, and articles of manufacture for semi-automatic firearm systems, such as semi-automatic cone-breech firearm systems. In some embodiments, for example, an engaging face of a tapered semi-automatic firearm bolt comprises a cartridge guide cut (and/or otherwise formed) therein, the cartridge guide permitting a cartridge in a semi-automatic firearm system to be successfully seated in the semi-automatic bolt and loaded into the chamber of a semi-automatic cone-breech firearm system. In some embodiments, the cartridge guide permits utilization of a plunger-style ejector in the semi-automatic cone-breech firearm system. According to some embodiments, the plunger-style ejector may be rounded and/or chamfered. In some embodiments, the cartridge guide may comprise end-fillets that allow for an increased bolt-face taper and/or that facilitate reduced interference with and/or reduced modification of a plunger-style ejector.

Some embodiments herein are descriptive of semi-automatic barrel extension devices configured to accept an eight (8)-lug semi-automatic firearm bolt and/or configured to accept a tapered semi-automatic firearm bolt of a semi-automatic cone-breech firearm system (e.g., seven (7)-lug and/or eight (8)-lug). The barrel extension may, for example, comprise a cone-shaped bolt-mating surface, rounded or chamfered locking lug channels, and/or rounded side-by-side cartridge guides. According to some embodiments, a tapered semi-automatic bolt carrier may be configured to mate with the semi-automatic barrel extension.

II. Cartridge Extractor Embodiments

Turning initially to FIG. 1A, FIG. 1B, FIG. 1C, FIG. 1D, and FIG. 1E, perspective, side, top, bottom, and front views of a firearm cartridge extractor 130 according to some embodiments are shown. The cartridge extractor 130 may, for example, comprise an AR-15/M-16-style extractor as depicted. In some embodiments, the cartridge extractor 130 may comprise a first surface 132 and a second surface 134. According to some embodiments, the first surface 132 and the second surface 134 may comprise surfaces of and/or define a standard rectangular shaped portion or body of the cartridge extractor 130. The first surface 132 may generally be described as a "bottom" or lower surface of the cartridge extractor 130, for example, and/or the second surface 134 may generally be described as a "top" or upper surface of the cartridge extractor 130. According to some embodiments, the first/bottom surface 132 and/or a portion thereof may be shaped and/or configured to mate with a channel, groove, seat, and/or other feature of a semi-automatic firearm bolt (not shown in FIG. 1A, FIG. 1B, FIG. 1C, FIG. 1D, and FIG. 1E—e.g., the semi-automatic firearm bolt 210 of FIG. 2A, FIG. 2B, FIG. 2C, and FIG. 2D).

In some embodiments, the cartridge extractor 130 may comprise a seat 136 at a first and/or pivot end 130-1 of the cartridge extractor 130 and/or disposed on the first/bottom surface 132. The seat 136 may, for example, be configured and/or oriented to mate with and/or seat an extractor spring (not shown in FIG. 1A, FIG. 1B, FIG. 1C, FIG. 1D, and FIG. 1E—e.g., the extractor spring 828 of FIG. 8). According to some embodiments, the cartridge extractor 130 may comprise a cartridge rim channel 138 cut and/or formed in the first/bottom surface 132 (e.g., at and/or proximate to a second and/or engaging end 130-2 of the cartridge extractor 130), the cartridge rim channel 138 forming, defining, and/or configured to operate in conjunction with a cartridge engaging flange 140 (e.g., at the engaging end 130-2 of the cartridge extractor 130). In some embodiments, the cartridge extractor 130 may comprise a flange or housing 142 formed on and/or coupled to the first surface 132, the housing 142 comprising and/or defining a pin hole 144. The pin hole 144 may, for example, be disposed, configured, and/or oriented to accept a pin (not shown in FIG. 1A, FIG. 1B, FIG. 1C, FIG. 1D, and FIG. 1E—e.g., the extractor retaining pin 826 of FIG. 8).

Figure 1A:
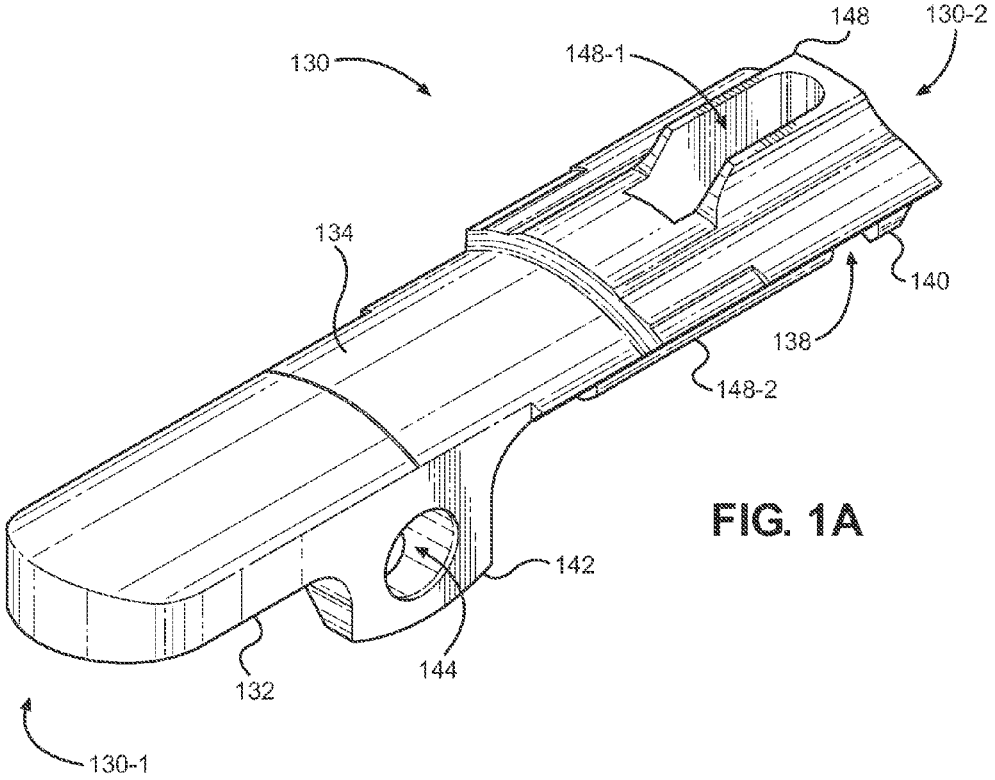
FIG. 1A, FIG. 1B, FIG. 1C, FIG. 1D, and FIG. 1E are perspective, side, top, bottom, and front views of a firearm cartridge extractor according to some embodiments.
Figure 1B:
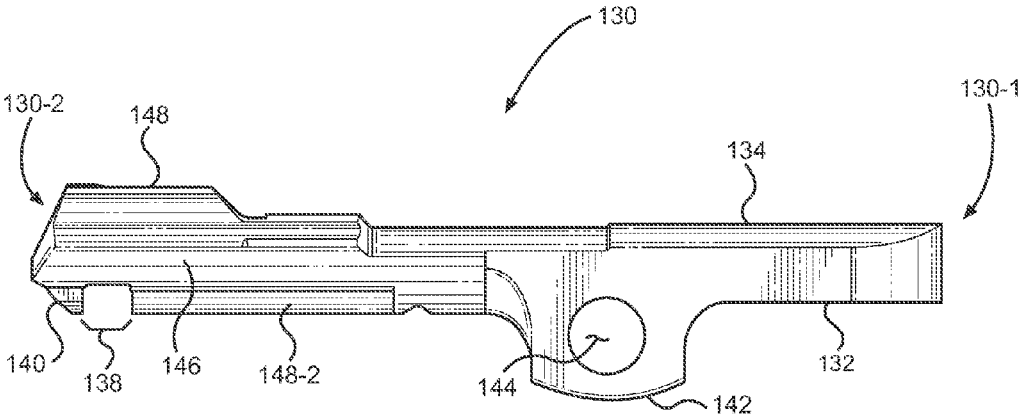
Figure 1C:
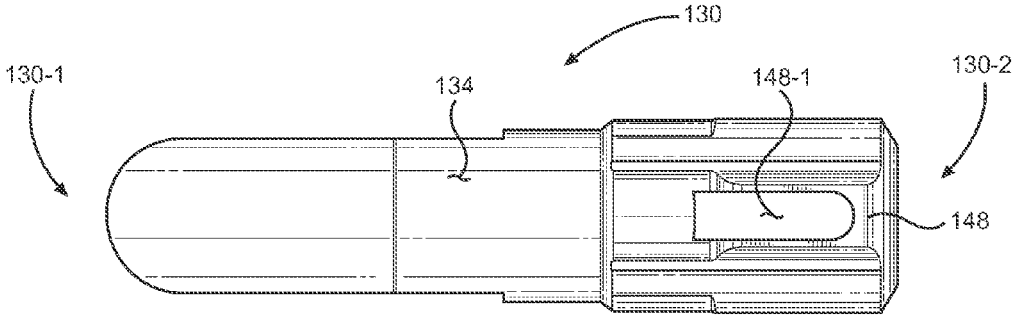
Figure 1D:
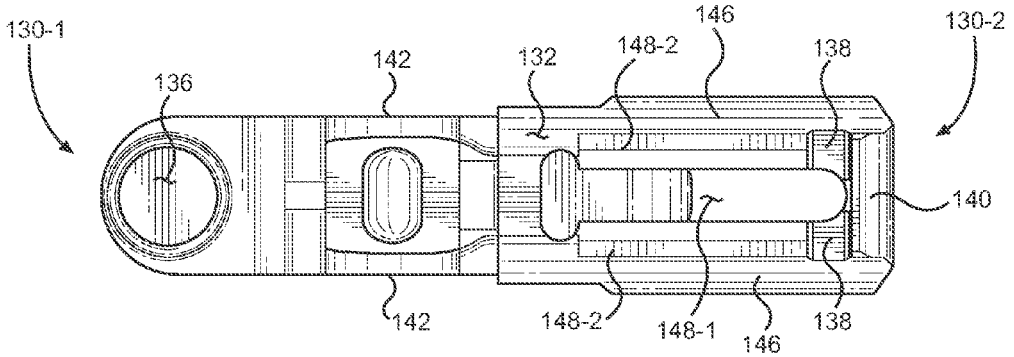
Figure 1E:
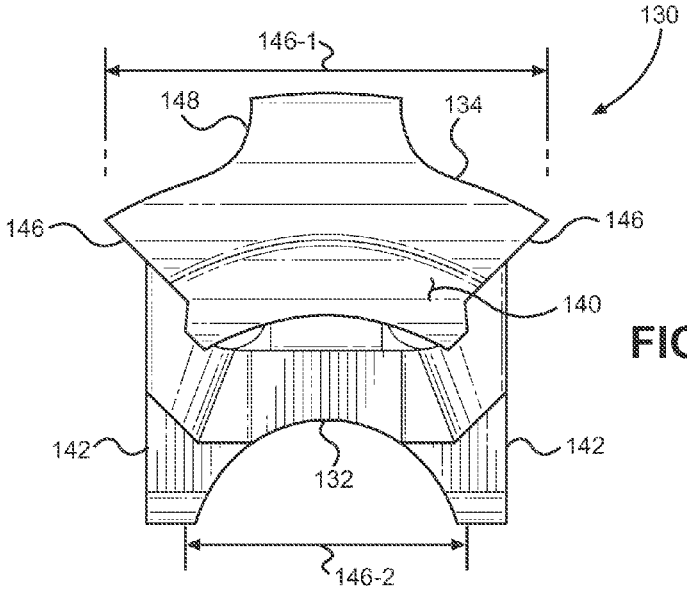

According to some embodiments, the cartridge extractor 130 may comprise angled sides 146 that decrease the width of at least the engaging end 130-2 of the cartridge extractor 130 from a first width 146-1 at the second/upper surface 134 to a second width 146-2 at the first/lower surface 132 (e.g., best depicted in FIG. 1E). In such a manner, for example, various advantages over prior art ammunition extractors may be realized. The cartridge extractor 130 comprising the angled sides 146 may, for example, permit the cartridge extractor 130 to be engaged with a semi-automatic firearm bolt in a seat thereof (not shown in FIG. 1A, FIG. 1B, FIG. 1C, FIG. 1D, and FIG. 1E), wherein the seat is smaller, narrower, and/or otherwise impinges less on adjacent locking lugs than that of a standard semi-automatic bolt and extractor combination. In some embodiments, the degree, orientation, and/or angle of the angled sides 146 may be configured to match and/or correspond to an angle associated with adjacent locking lugs of a semi-automatic firearm bolt. According to some embodiments, the angled sides 146 and/or a narrow-neck design (not specifically depicted in FIG. 1A, FIG. 1B, FIG. 1C, FIG. 1D, and FIG. 1E) may allow the cartridge extractor 130 to fit between adjacent locking lugs without requiring such lugs to be cut and/or impinged (e.g., in either a seven (7)-lug or eight (8)-lug bolt semi-automatic firearm system).

In some embodiments, the cartridge extractor 130 may comprise a locking lug sleeve 148. The locking lug sleeve 148 may, for example, define a lug passage 148-1 through the cartridge extractor 130. In some embodiments, the lug passage 148-1 may be configured and/or oriented to allow the cartridge extractor 130 to fit over a locking lug of a semi-automatic firearm bolt. According to some embodiments, the passage 148-1 may be configured to accept an eight ($8^{th}$)-lug of an eight (8)-lug semi-automatic firearm bolt (e.g., the specially-configured eighth ($8^{th}$) lug 212*h* of FIG. 2A, FIG. 2B, FIG. 2C, and FIG. 2D). In such a manner, for example, extractor functionality may be maintained and/or preserved while allowing an eight (8)-lug bolt to be utilized in a semi-automatic firearm system. According to some embodiments, the lower portion of the locking lug sleeve 148 and/or the first/lower surface 132 in proximity to the lug passage 148-1, may comprise lug seat rails 148-2. The lug seat rails 148-2 may, for example, be configured to properly position and/or maintain proper position of the cartridge extractor 130 (and/or the locking lug sleeve 148) with respect to a corresponding locking lug.

In some embodiments, the cartridge extractor 130 may comprise (e.g., at and/or near the engaging end 130-2 comprising the cartridge rim channel 138 and the cartridge engaging flange 140) elongated flange portions (not specifically shown in FIG. 1A, FIG. 1B, FIG. 1C, FIG. 1D, and FIG. 1E, such as in accordance with the wide-flanged extractor design of co-pending U.S. patent application Ser. No. 13/548,168 filed on Jul. 12, 2012 and titled "WIDE-FLANGED CARTRIDGE EXTRACTOR", incorporated by reference herein.

According to some embodiments, any or all of the components 130-1, 130-2, 132, 134, 136, 138, 140, 142, 144, 146, 146-1, 146-2, 148, 148-1, 148-2 of the cartridge extractor 130 may be similar in configuration and/or functionality to any similarly named and/or numbered components described herein. Fewer or more components 130-1, 130-2, 132, 134, 136, 138, 140, 142, 144, 146, 146-1, 146-2, 148, 148-1, 148-2 (and/or portions thereof) and/or various configurations of the components 130-1, 130-2, 132, 134, 136, 138, 140, 142, 144, 146, 146-1, 146-2, 148, 148-1, 148-2 may be included in the cartridge extractor 130 without deviating from the scope of embodiments described herein. In some embodiments, one or more of the various components 130-1, 130-2, 132, 134, 136, 138, 140, 142, 144, 146, 146-1, 146-2, 148, 148-1, 148-2 may not be needed and/or desired in the cartridge extractor 130.

III. Firearm Bolt Embodiments

Referring now to FIG. 2A, FIG. 2B, FIG. 2C, and FIG. 2D, perspective, side, top, and front views of a semi-automatic eight (8)-lug firearm bolt 210 according to some embodiments are shown. In some embodiments, the firearm bolt 210 may comprise a barrel extension guide portion 210-1, eight (8) locking lugs 212*a-h* (e.g., having a taper 212-1 and/or comprising a specially-configured eighth ($8^{th}$) lug 212*h*—e.g., angled, rounded, chamfered, and/or tapered or otherwise designed to engage with a specially-designed extractor such as the extractor 130 of FIG. 1A, FIG. 1B, FIG. 1C, FIG. 1D, and FIG. 1E), a breech face 214, a cartridge guide 214-1, cartridge guide fillets 214-2, and/or a cartridge seat 216. According to some embodiments, the cartridge seat 216 may comprise a firing pin hole 216-1 through which a firing pin (not shown in FIG. 2A, FIG. 2B, FIG. 2C, and FIG. 2D—e.g., the firing pin 820 of FIG. 8) may protrude to forcibly ignite primer in a cartridge (also not shown in FIG. 2A, FIG. 2B, FIG. 2C, and FIG. 2D—e.g., the cartridge 808 of FIG. 8) seated in the cartridge seat 216. In some embodiments, the firearm bolt 210 and/or the cartridge seat 216 may comprise an ejector hole 216-2, configured to receive and/or accept a plunger-style ejector, ejector spring, and/or mechanism (also not shown in FIG. 2A, FIG. 2B, FIG. 2C, and FIG. 2D—e.g., the cartridge ejector 850 and/or ejector spring 852 of FIG. 8). As depicted for non-limiting purposes of illustration only, the firearm bolt 210 comprises a center-fire bolt configuration.

In some embodiments, the firearm bolt 210 may comprise an extractor channel 218. According to some embodiments, the extractor channel 218 may comprise a seat 218-1, a pin hole 218-2, and/or one or more extractor rail cuts 218-3. The seat 218-1 may be configured to accept a protrusion from an AR-15/M-16-style extractor (not shown in FIG. 2A, FIG. 2B, FIG. 2C, and FIG. 2D—e.g., the cartridge extractor 130 of FIG. 1A, FIG. 1B, FIG. 1C, FIG. 1D, and FIG. 1E), for example, and/or (in the case of an AR-15/M-16-style extractor) an extractor spring (also not shown; e.g., the extractor spring 828 of FIG. 8). In the case of an AR-15/M-16-style extractor, the pin hole 218-2 may be cut and/or formed into one or more of the sides of the extractor channel 218 and/or may accept a pin (not shown in FIG. 2A, FIG. 2B, FIG. 2C, and FIG. 2D—e.g., the extractor retaining pin 826 of FIG. 8) that rotatably attaches the AR-15/M-16-style extractor to the firearm bolt 210.

According to some embodiments, the cartridge guide 214-1 may comprise a cut, channel, and/or other formation and/or feature of the breech face 214. In such a manner, for example, the firearm bolt 210 may be specially-configured to permit and/or facilitate repeated and/or automatic loading of a cartridge (not shown) into the cartridge seat 216. According to some embodiments (as depicted), the breech face 214 may be cone-shaped and/or tapered or chamfered in accordance with the taper 212-1. According to some embodiments, the cartridge guide 214-1 may comprise the cartridge guide fillets 214-2. The cartridge guide fillets 214-2 may, for example, be formed by graduating the cut of the cartridge guide 214-1 into the breech face 214 and/or may be formed in the cartridge guide 214-1 after formation thereof. The cartridge guide fillets 214-2 may generally facilitate cartridge entry into the cartridge seat 216 via the cartridge guide 214-1 and/or may permit functioning of the cartridge guide 214-1 without interference with and/or without requiring modification to a plunder-style ejector disposed within the ejector hole 216-2.

Figure 2D:
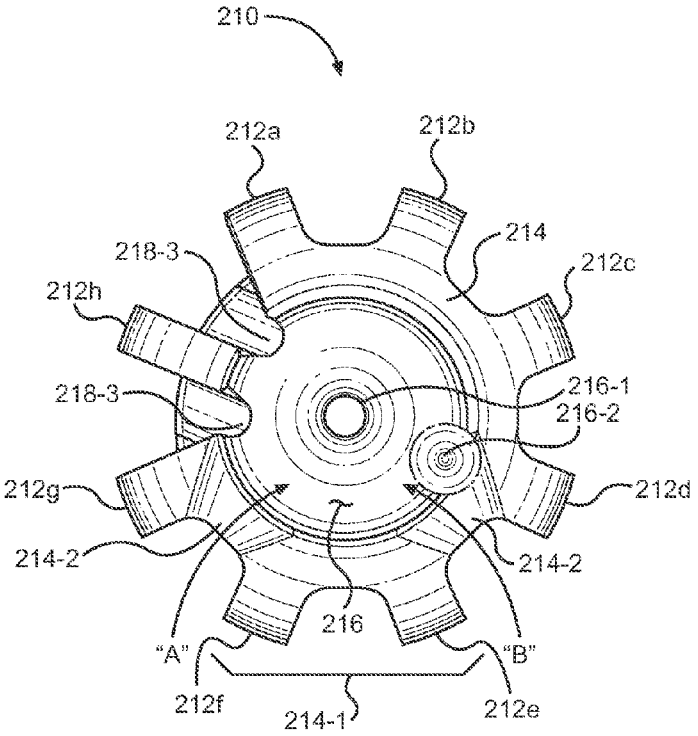

As depicted in FIG. 2D by the line paths "A" and "B", for example, cartridges from a staggered or double-stacked column magazine (neither shown on FIG. 2A, FIG. 2B, FIG. 2C, and FIG. 2D) may enter the cartridge guide 214-1 and/or the cartridge seat 216 via the fifth ($5^{th}$) lug 212*e* and/or the sixth ($6^{th}$) lug 212*f*, typically in alternating fashion. As a cartridge moves upward from the magazine and into the cartridge guide 214-1, the corresponding cartridge guide fillet 214-2 may direct the cartridge (e.g., the rear of the cartridge, as would typically engage with the breech face 214 of the firearm bolt 210) into the center of the cartridge seat 216. For cartridges entering from the staggered magazine from the right via cartridge path "B" (from the perspective shown in FIG. 2D; e.g., across the fifth ($5^{th}$) lug 212*e*), the corresponding cartridge guide fillet 214-2 may also guide the cartridge over a seated plunger-style ejector such that the cartridge engages with an end of the ejector as opposed to a side of the ejector (e.g., such side-engaging which would likely result in a jammed cartridge or improperly seated cartridge).

In some embodiments, the barrel extension guide portion 210-1 may comprise a substantially smooth and/or uniform portion of the cylindrical body of the firearm bolt 210. The barrel extension guide portion 210-1 may, for example, initiate at or near the rear of the locking lugs 212*a-h* and extend rearward along the firearm bolt 210. According to some embodiments, the distance that the barrel extension guide portion 210-1 extends along the length of the firearm bolt 210 may be approximate to the length of the locking lugs 212*a-h*. In some embodiments, the barrel extension guide portion 210-1 may be configured to mate with and/or guide or position a barrel extension device (not shown in FIG. 2A, FIG. 2B, FIG. 2C, and FIG. 2D—e.g., the barrel extension device 470 of FIG. 4A, FIG. 4B, FIG. 4C, and/or FIG. 4D). The barrel extension guide portion 210-1 may, for example, provide a mating, resting, and/or seating surface configured to couple and/or mate with one or more portions of a barrel extension device such as the locking lug channel peaks 474-1 of the barrel extension device 470 of FIG. 4A, FIG. 4B, FIG. 4C, and FIG. 4D. In such a manner, for example, as the barrel extension guide portion 210-1 may be substantially smooth and/or free of obstructions, locking lug peaks may be smoothly and freely accepted and/or seated, minimizing interferences and/or providing for a more secure fir there between (e.g., decreasing an amount of clearance or "play" between the firearm bolt 210 and a mated barrel extension device. An enhanced fit may, for example, decrease blow-back and/or other malfunction occurrences in a semi-automatic firearm system.

According to some embodiments, a method may comprise machining, manufacturing, and/or modifying the firearm bolt 210 to include the barrel extension guide portion 210-1, the cartridge guide 214-1, and/or the cartridge guide fillets 214-2. A first cut may be made to form and/or define the taper 212-1 (e.g., cone-shape) of the breech face 214 and/or locking lugs 212, for example, and a second cut may be made to form and/or define the cartridge guide 214-1 and/or the cartridge guide fillets 214-2 (e.g., in and/or through the breech face 214). In some embodiments, a computer-readable medium may store specially-programmed instructions that when executed by a processing device (such as a processing device of a Computer Numerical Control (CNC) machine and/or machine tool) result in the performance of the method and/or in the creation of the barrel extension guide portion 210-1, the cartridge guide 214-1, and/or the cartridge guide fillets 214-2. In some embodiments, such instructions may be stored on a computer-readable memory, which is defined herein as a subset of computer readable media that does not include transitory media types.

In some embodiments, any or all of the components 210-1, 212*a-h*, 214, 214-1, 214-2, 216, 216-1, 216-2, 218, 218-1, 218-2, 218-3 of the firearm bolt 210 may be similar in configuration and/or functionality to any similarly named and/or numbered components described herein. Fewer or more components 210-1, 212*a-h*, 214, 214-1, 214-2, 216, 216-1, 216-2, 218, 218-1, 218-2, 218-3 (and/or portions thereof) and/or various configurations of the components 210-1, 212*a-h*, 214, 214-1, 214-2, 216, 216-1, 216-2, 218, 218-1, 218-2, 218-3 may be included in the firearm bolt 210 without deviating from the scope of embodiments described herein. In some embodiments, one or more of the various components 210-1, 212*a-h*, 214, 214-1, 214-2, 216, 216-1, 216-2, 218, 218-1, 218-2, 218-3 may not be needed and/or desired in the firearm bolt 210.

According to some embodiments, the specially-configured eighth ($8^{th}$) lug 212*h* may be formed, configured and/or disposed to mate with, accept, and/or guide or position a specially-configured cartridge extractor such as the cartridge extractor 130 of FIG. 1A, FIG. 1B, FIG. 1C, FIG. 1D, and FIG. 1E. The specially-configured eighth ($8^{th}$) lug 212*h* may, for example, be configured to fit into and/or through a lug passage of a specially-configured cartridge extractor (e.g., the lug passage 148-1 of the locking lug sleeve 148 of FIG. 1A, FIG. 1B, FIG. 1C, FIG. 1D, and FIG. 1E).

IV. Cartridge Extractor and Firearm Bolt Embodiments

Figure 3A:
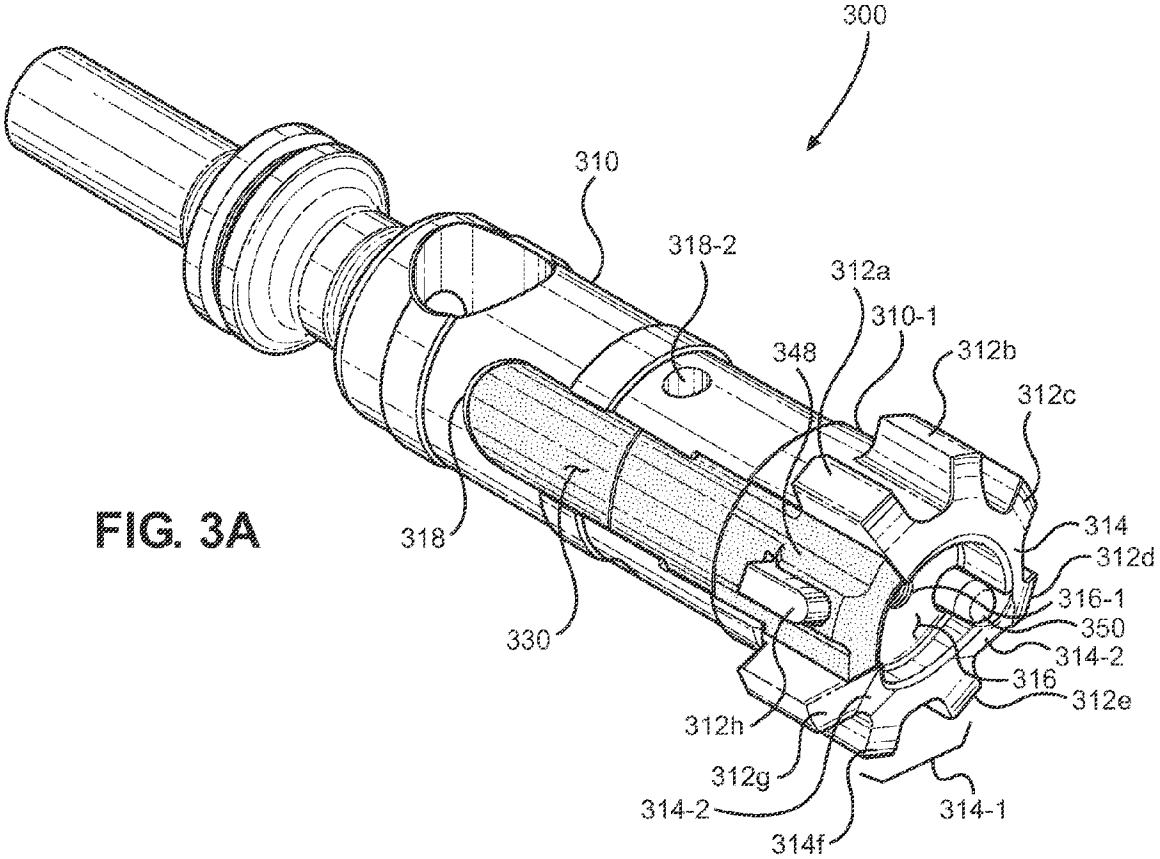
FIG. 3A, FIG. 3B, and FIG. 3C are perspective, top, and front views of a semi-automatic eight (8)-lug firearm bolt assembly according to some embodiments.
Figure 3B:
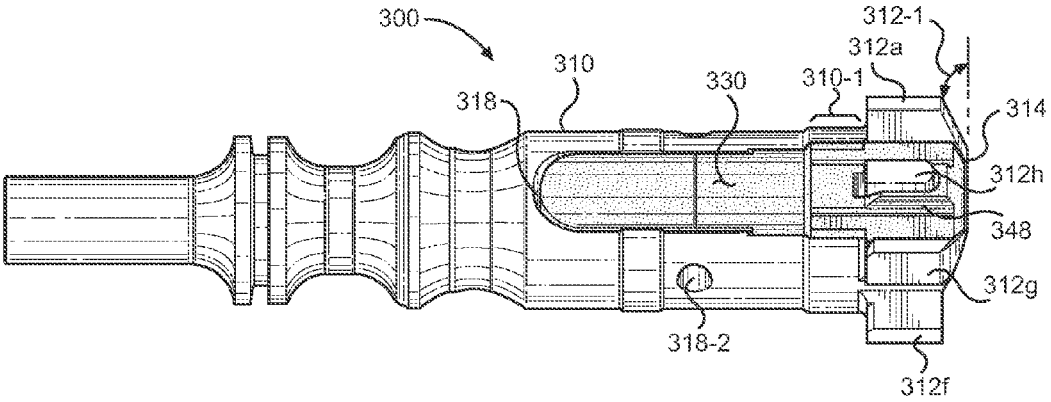
Figure 3C:
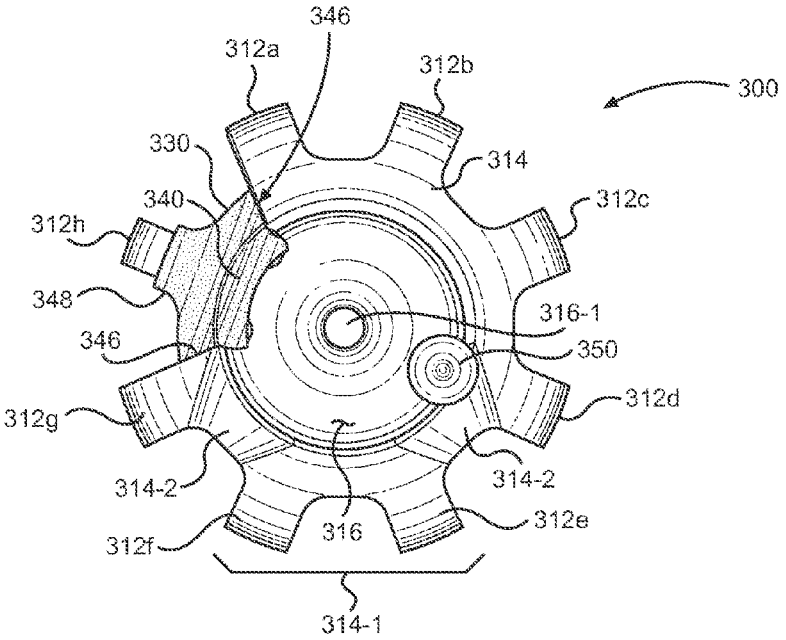

Turning to FIG. 3A, FIG. 3B, and FIG. 3C, for example, perspective, top, and front views of a semi-automatic eight (8)-lug firearm bolt assembly 300 according to some embodiments are shown. In some embodiments, the firearm bolt assembly 300 may comprise a firearm bolt 310 comprising a barrel extension guide portion 310-1, eight (8) locking lugs 312*a-h* (e.g., having a taper 312-1 and/or comprising a specially-configured eighth ($8^{th}$) lug 312*h*), a breech face 314, a cartridge guide 314-1, cartridge guide fillets 314-2, and/or a cartridge seat 316. According to some embodiments, the cartridge seat 316 may comprise a firing pin hole 316-1 through which a firing pin (not shown in FIG. 2A, FIG. 2B, FIG. 2C, and FIG. 2D—e.g., the firing pin 820 of FIG. 8) may protrude to forcibly ignite primer in a cartridge (also not shown in FIG. 2A, FIG. 2B, FIG. 2C, and FIG. 2D—e.g., the cartridge 808 of FIG. 8) seated in the cartridge seat 316.

In some embodiments, the firearm bolt 310 may comprise an extractor channel 318. According to some embodiments, the extractor channel 318 may comprise a pin hole 318-2 and/or may seat, couple, and/or mate with a cartridge extractor 330. In the case of an AR-15/M-16-style extractor (as depicted), the pin hole 318-2 may be cut and/or formed into one or more of the sides of the extractor channel 318 and/or may accept a pin (not shown in FIG. 2A, FIG. 2B, FIG. 2C, and FIG. 2D—e.g., the extractor retaining pin 826 of FIG. 8) that rotatably attaches the a cartridge extractor 330 to the firearm bolt 310. In some embodiments, the cartridge extractor 330 may comprise a cartridge engaging flange 340, angled sides 346, and/or a locking lug sleeve 348 that fits over and/or accepts the eighth ($8^{th}$) lug 312*h*. In some embodiments, the firearm bolt assembly 300 may comprise a plunger-style cartridge ejector 350 (e.g., disposed in or on the cartridge seat 316). As depicted for non-limiting purposes of illustration only, the firearm bolt assembly 300 comprises a center-fire bolt assembly configuration.

According to some embodiments, the fifth ($5^{th}$) lug 312*e* and/or the sixth ($6^{th}$) lug 312*f* may be configured to define the cartridge guide 314-1. In such a manner, for example, cartridges (not shown in FIG. 2A, FIG. 2B, FIG. 2C, and FIG. 2D) may be guided (e.g., with facilitation and/or direction from the cartridge guide fillets 314-2) into the cartridge seat 316 and/or engaged with or by the cartridge engaging flange 340 of the cartridge extractor 330. Entry of the cartridge into the cartridge seat 316 may also depress and/or engage with the cartridge ejector 350.

In some embodiments, the barrel extension guide portion 310-1 may comprise a substantially smooth and/or uniform portion of the cylindrical body of the firearm bolt 310. The barrel extension guide portion 310-1 may, for example, initiate at or near the rear of the locking lugs 312*a-h* and extend rearward along the firearm bolt 310. According to some embodiments, the distance that the barrel extension guide portion 310-1 extends along the length of the firearm bolt 310 may be approximate to the length of the locking lugs 312*a-h*. In some embodiments, the barrel extension guide portion 310-1 may be configured to mate with and/or guide or position a barrel extension device (not shown in FIG. 3A, FIG. 3B, FIG. 3C—e.g., the barrel extension device 470 of FIG. 4A, FIG. 4B, FIG. 4C, and/or FIG. 4D). The barrel extension guide portion 310-1 may, for example, provide a mating, resting, and/or seating surface configured to couple and/or mate with one or more portions of a barrel extension device such as the locking lug channel peaks 474-1 of the barrel extension device 470 of FIG. 4A, FIG. 4B, FIG. 4C, and FIG. 4D.

In some embodiments, any or all of the components 310, 310-1, 312*a-h*, 314, 314-1, 314-2, 316, 316-1, 318, 318-2, 330, 346, 348, 350 of the firearm bolt assembly 300 may be similar in configuration and/or functionality to any similarly named and/or numbered components described herein. Fewer or more components 310, 310-1, 312*a-h*, 314, 314-1, 314-2, 316, 316-1, 318, 318-2, 330, 346, 348, 350 (and/or portions thereof) and/or various configurations of the components 310, 310-1, 312*a-h*, 314, 314-1, 314-2, 316, 316-1, 318, 318-2, 330, 346, 348, 350 may be included in the firearm bolt assembly 300 without deviating from the scope of embodiments described herein. In some embodiments, one or more of the various components 310, 310-1, 312*a-h*, 314, 314-1, 314-2, 316, 316-1, 318, 318-2, 330, 346, 348, 350 may not be needed and/or desired in the firearm bolt assembly 300.

V. Barrel Extension Embodiments

Referring to FIG. 4A, FIG. 4B, FIG. 4C, and FIG. 4D, perspective, side, top, and front views of a barrel extension device 470 according to some embodiments are shown. In some embodiments, the barrel extension device 470 may be configured to accept a semi-automatic firearm bolt and/or bolt assembly (neither shown in FIG. 4A, FIG. 4B, FIG. 4C, and FIG. 4D—e.g., the firearm bolt 210 of FIG. 2A, FIG. 2B, FIG. 2C, and FIG. 2D and/or the firearm bolt assembly 300 of FIG. 3A, FIG. 3B, and FIG. 3C) and/or mate with and/or couple to a barrel of a firearm (not shown in FIG. 4A, FIG. 4B, FIG. 4C, and FIG. 4D—e.g., the barrel 880 of FIG. 8). The barrel extension device 470 may, for example, comprise a first end 470-1 configured and/or disposed to accept a seven (7) and/or eight (8)-lug semi-automatic firearm bolt and/or a second end 470-2 comprising one or more barrel coupling features 472*a-b*. In some embodiments, the barrel coupling features 472*a-b* may comprise a threaded portion 472*a* configured to rotatably engage with corresponding threads of a barrel (not shown in FIG. 4A, FIG. 4B, FIG. 4C, and FIG. 4D—e.g., the threaded portion 782 of FIG. 7) and/or a locator hole 472*b* which allows for and/or facilitates proper alignment and/or coupling of the barrel extension device 470 to a corresponding barrel.

According to some embodiments, the first end 470-1 of the barrel extension device 470 may comprise a bolt engaging face 470-3 and/or a plurality of lug "ways" or lug channels 474*a-h* (e.g., disposed, formed, and/or cut in the bolt engaging face 470-3, thereby creating and/or defining one or more locking lug channel peaks 474-1) configured to accept locking lugs (not shown in FIG. 4A, FIG. 4B, FIG. 4C, and FIG. 4D—e.g., the locking lugs 212*a-h*, 312*a-h* of FIG. 2A, FIG. 2B, FIG. 2C, FIG. 2D, FIG. 3A, FIG. 3B, and/or FIG. 3C) of a firearm bolt. The locking lug channels 474*a-h* (and/or corresponding "extension lugs" or locking lug channel peaks 474-1), in accordance with some embodiments, may be rounded, chamfered, and/or tapered (e.g., as depicted). In such a manner, for example, less interference, better guidance, and/or less likelihood of bolt jamming may be provided. According to some embodiments, the bolt engaging face 470-3 of the first end 470-1 of the barrel extension device 470 (e.g., and the locking lug channels 474*a-h* and/or locking lug channel peaks 474-1 thereof) may be tapered (e.g., fully concave cone-shaped—e.g., a full "forcing cone") such as in accordance with a taper (e.g., a single taper as shown) of a corresponding firearm bolt and/or bolt carrier in a cone-breech (e.g., a cone-shaped "breech block") semi-automatic firearm system. According to some embodiments, this full forcing cone allows for increased surface area contact between the barrel extension device 470 and a mated bolt carrier (not shown—e.g., the bolt carrier 502 of FIG. 5), providing for increased strength and reliability in a semi-automatic firearm system.

Figure 4A:
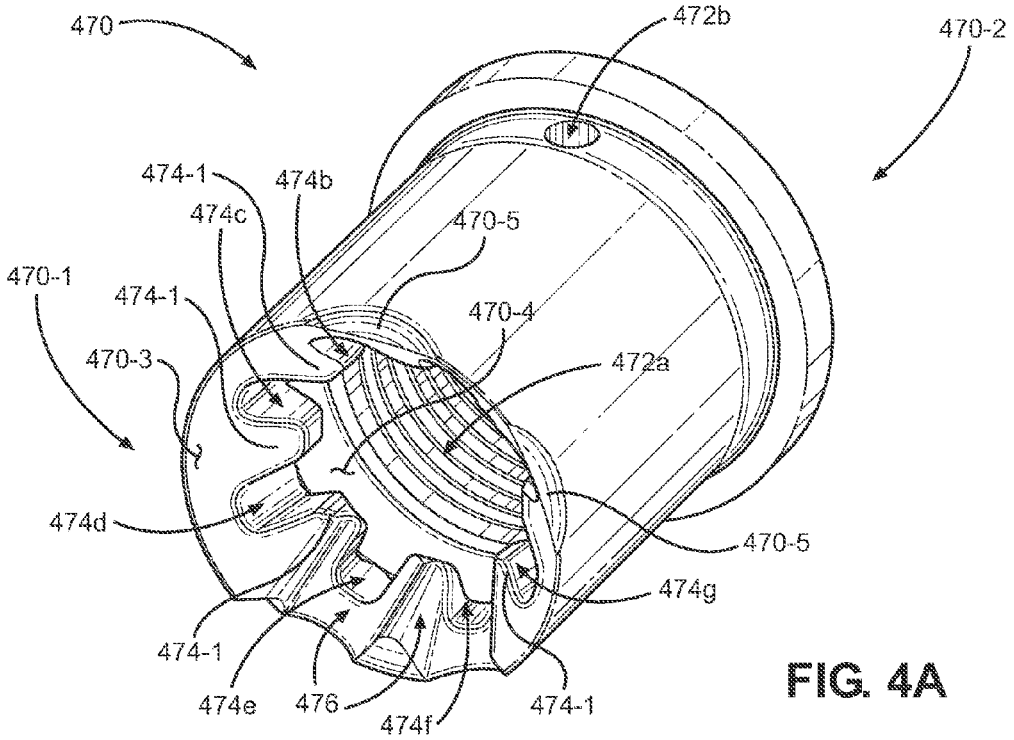
FIG. 4A, FIG. 4B, FIG. 4C, and FIG. 4D are perspective, side, top, and front views of a firearm barrel extension device according to some embodiments.
Figure 4B:
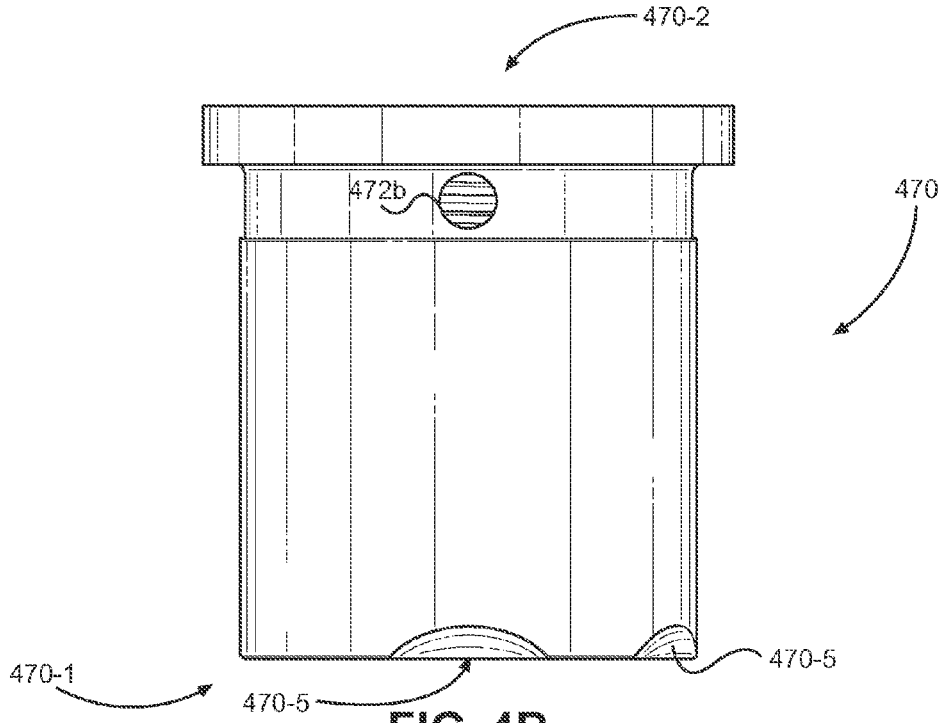
Figure 4C:
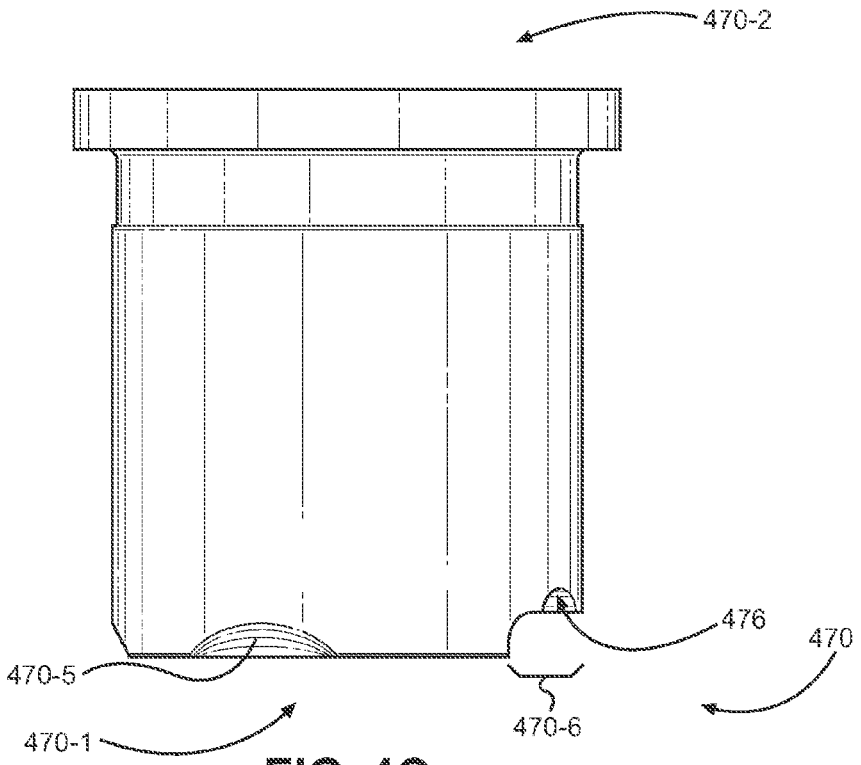
Figure 4D:
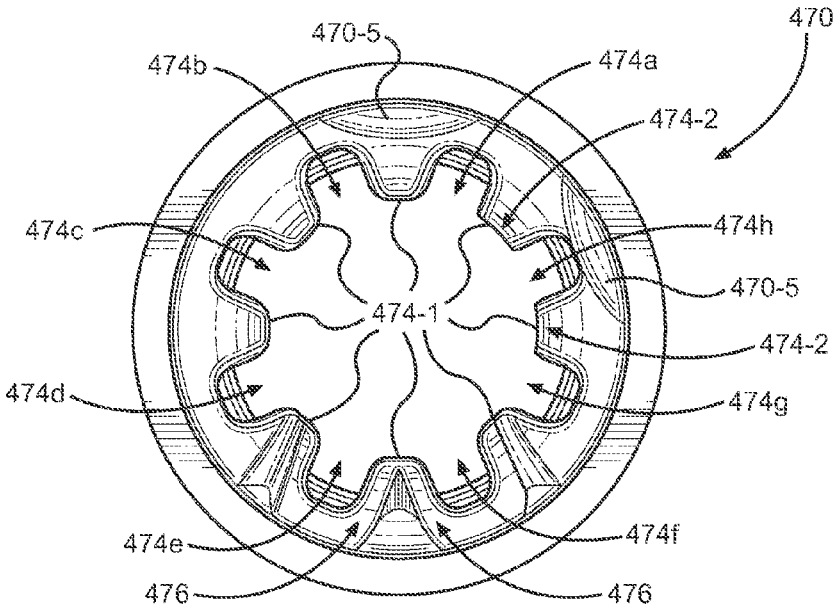

In some embodiments, the first end 470-1 of the barrel extension device 470 may comprise one or more (e.g., a plurality of) cartridge feed ramps 476. The cartridge feed ramps 476 may, for example, be configured to facilitate acceptance (e.g., loading) of one or more firearm cartridges, such as the bullet-end thereof (not shown in FIG. 4A, FIG. 4B, FIG. 4C, and FIG. 4D—e.g., the cartridge 808 of FIG. 8) and/or locking lugs of a corresponding firearm bolt that provides the cartridge to the barrel extension device 470. In some embodiments, the cartridge feed ramps 476 may be configured and/or oriented to accept particular locking lugs of a corresponding firearm bolt, such as the fifth ($5^{th}$) lug 212*e*, 312*e* and/or the sixth (6th) lug 212*f*, 312*f* (e.g., comprising and/or defining the cartridge 214-1, 314-1) of FIG. 2A, FIG. 2B, FIG. 2C, FIG. 2D, FIG. 3A, FIG. 3B, and/or FIG. 3C. In some embodiments, as shown in FIG. 4A, the cartridge feed ramps 476 may be recessed into the bolt engaging face 470-3 and, e.g., thereby define an interruption in the (e.g., single) taper of the bolt engaging face 470-3.

According to some embodiments, the barrel extension device 470 may comprise a locking lug mating surface 470-4. The locking lug mating surface 470-4 may, for example, be configured to accept, position, and/or support locking lugs of a mated firearm bolt, such as after such lugs have passed through the locking lug channels 474*a-h* and/or have been rotated with respect to the barrel extension device 470 (e.g., radially offsetting the locking lugs from the locking lug channels 474*a-h* to lock the firearm bolt to the barrel extension device 470).

In some embodiments, the barrel extension device 470 may comprise one or more bolt carrier chamfers 470-5. Due to the taper of the bolt engaging face 470-3, for example, a corresponding bolt carrier (not shown in FIG. 4A, FIG. 4B, FIG. 4C, and FIG. 4D—e.g., the bolt carrier 502 of FIG. 5) providing a firearm bolt to the barrel extension device 470 may insert deeper into the barrel extension device 470 than it otherwise would in the case that the bolt engaging face 470-3 comprises a planar surface, e.g. standard to typical barrel extension devices. The bolt carrier chamfers 470-5 may, for example, allow for a corresponding tapered bolt carrier to be inserted into the tapered first end 470-1 by providing clearance for one or more bolt carrier features that would not otherwise contact or interfere with the barrel extension device 470. In some embodiments, the barrel extension device 470 may be longer than a standard barrel extension device, such that the cartridge feed ramps 476 are positioned closer to an entry point of cartridges from a magazine into a receiver assembly (neither of which are shown in FIG. 4A, FIG. 4B, FIG. 4C, and FIG. 4D)—reducing likelihood of cartridge jamming. In some embodiments, the locking lug channels 474*a-h* may be formed and/or defined utilizing end-milling and/or standard end-mills—e.g., as opposed to broaching and/or wire Electrical Discharge Machining (EDM) processes typically utilized to form lug channels in standard barrel extension designs. In such a manner, for example, deeper locking lug channels 474*a-h* may be formed (e.g., as opposed to typical channels) which, along with the chamfers and rounding thereof, may allow for increased reliability of operation in the case that foreign materials are introduced into the barrel extension device 470 (e.g., sand, residue, debris).

In some embodiments, the barrel extension device 470 may comprise a magazine cut 470-6. In the case that the barrel extension device 470 is longer than standard barrel extension devices and accordingly is positioned closer to the entry point of the cartridges from the magazine, for example, the magazine cut 470-6 may be provided to ensure that the barrel extension device 470 does not interfere with the magazine (e.g., when the magazine is attached to a receiver assembly in which the barrel extension device 470 is disposed).

In some embodiments, the locking lug channels 474*a-h* and/or locking lug channel peaks 474-1 may be configured to accept and/or facilitate operation of a firearm cartridge extractor (not shown in FIG. 4A, FIG. 4B, FIG. 4C, and FIG. 4D—e.g., the cartridge extractor 130 of FIG. 1A, FIG. 1B, FIG. 10, FIG. 1D, and FIG. 1E). One or more of the locking lug channel peaks 474-1 may be configured to be shorter than the other locking lug channel peaks 474-1, for example, defining one or more shortened peaks 474-2. As depicted, for example, the locking lug channel peaks 474-1 between the eighth locking lug channel 474*h* and both of the first locking lug channel 474*a* and the seventh locking lug channel 474*g* may be configured to be shorter, defining the two shortened peaks 474-2. In such a manner, for example, clearance may be provided for an extractor such as an extractor configured to fit overtop an eight locking lug of a firearm bolt (not shown) disposed within the eighth locking lug channel 474*h*. Such clearance may permit the barrel extension device 470 to be longer than standard devices while preventing interference with extractor operation and/or may decrease the likelihood of firearm system failure due to foreign containments entering the barrel extension device 470 during firearm operation.

According to some embodiments, any or all of the components 470-1, 470-2, 470-3, 470-4, 470-5, 470-6, 472*a-b*, 474*a-h*, 474-1, 474-2, 476 of the barrel extension device 470 may be similar in configuration and/or functionality to any similarly named and/or numbered components described herein. Fewer or more components 470-1, 470-2, 470-3, 470-4, 470-5, 470-6, 472*a-b*, 474*a-h*, 474-1, 474-2, 476 (and/or portions thereof) and/or various configurations of the components 470-1, 470-2, 470-3, 470-4, 470-5, 470-6, 472*a-b*, 474*a-h*, 474-1, 474-2, 476 may be included in the barrel extension device 470 without deviating from the scope of embodiments described herein. In some embodiments, one or more of the various components 470-1, 470-2, 470-3, 470-4, 470-5, 470-6, 472*a-b*, 474*a-h*, 474-1, 474-2, 476 may not be needed and/or desired in the barrel extension device 470.

Figure 5:
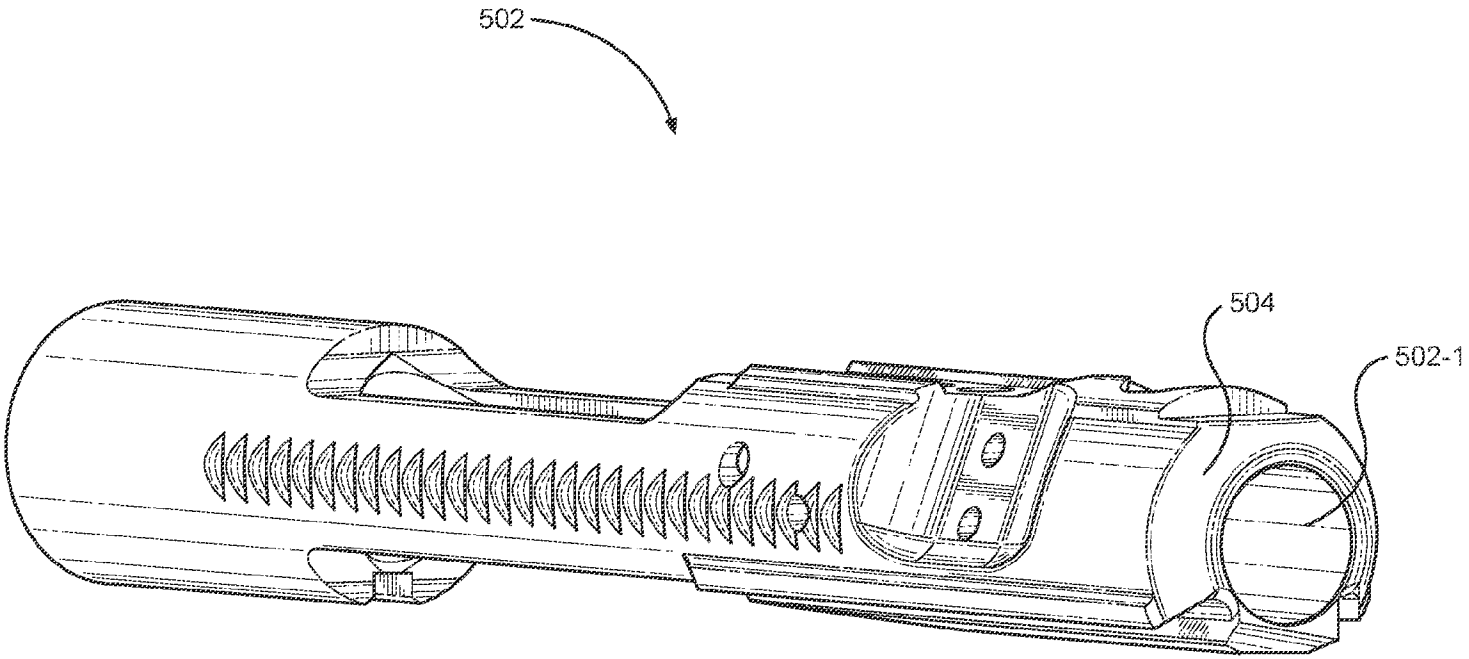
FIG. 5 is a perspective diagram of a firearm bolt carrier according to some embodiments.

Turning to FIG. 5, a perspective diagram of a semi-automatic firearm bolt carrier 502 according to some embodiments is shown. The firearm bolt carrier 502 may, for example comprise a bore, void, and/or other opening 502-1 configured to accept a semi-automatic firearm bolt and/or bolt assembly (not shown in FIG. 5—e.g., the firearm bolt 210 of FIG. 2A, FIG. 2B, FIG. 2C, and FIG. 2D and/or the firearm bolt assembly 300 of FIG. 3A, FIG. 3B, and FIG. 3C). In some embodiments, the firearm bolt carrier 502 may comprise a barrel face 504 configured to mate with and/or couple to (e.g., utilizing a locking firearm bolt) a barrel and/or barrel extension device (not shown in FIG. 5—e.g., the barrel extension device 470 of FIG. 4A, FIG. 4B, FIG. 4C, and FIG. 4D). According to some embodiments (as depicted in FIG. 5), the barrel face 504 of the firearm bolt carrier 502 may be tapered, chamfered, and/or rounded (e.g., to form a convex shape), such as to match a corresponding taper, chamfer, rounding (e.g., concave shape), etc. of a corresponding cone-breech barrel and/or barrel extension. In such a manner, for example, the amount of mating surface between the firearm bolt carrier 502 (and/or barrel face 504 thereof) and a mated barrel and/or barrel extension may be increased, providing a strengthened mating that is less prone to failure. The tapered and/or cone-breech-style mating may also or alternatively allow for a bolt assembly to be more effectively and/or securely seated in a firearm breech (e.g., mated and/or coupled to a barrel and/or barrel extension) by allowing the firearm bolt carrier 502 to be inserted more deeply into the barrel extension/chamber than would be possible in the case that the barrel face 504 were planar in configuration.

Figure 6:
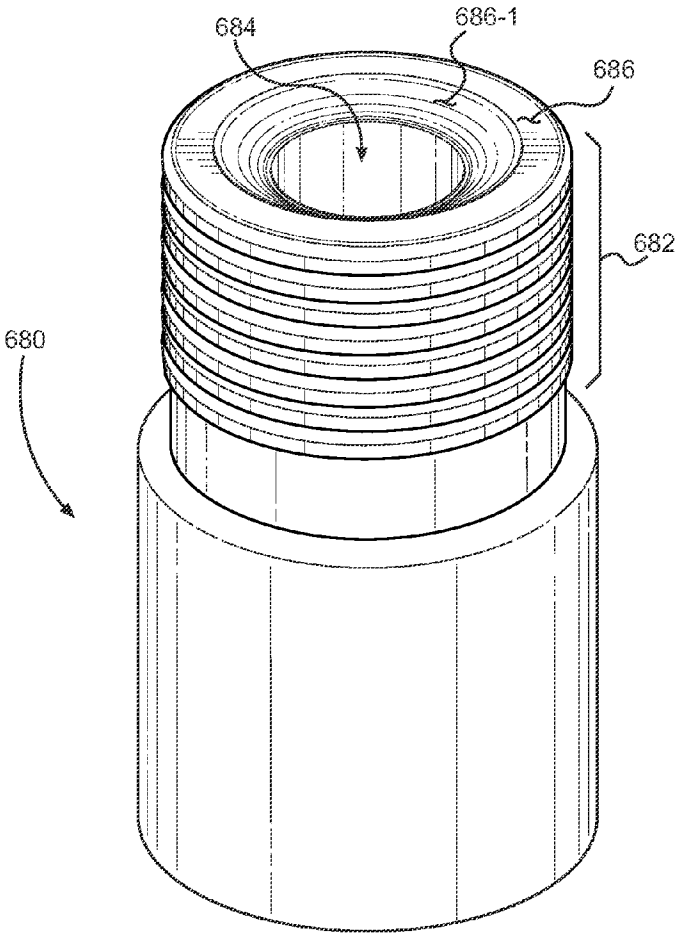
FIG. 6 PRIOR ART
FIG. 6 is a perspective breech-end diagram of a prior art firearm barrel.

Referring now to FIG. 6, a perspective breech-end diagram of a prior art firearm barrel 680 is shown. The prior art firearm barrel 680 may generally comprise, for example, a threaded portion 682 configured to rotatably couple to a barrel extension device (not shown in FIG. 6), a chamber 684 configured to accept a firearm cartridge (or portion thereof; not shown in FIG. 6), and/or a breech surface 686. The breech surface 686 may generally be configured as a planar surface configured to engage with a corresponding planar surface of a firearm bolt (not shown in FIG. 6; e.g., thereby sealing a cartridge in the chamber 684). As depicted, the breech surface 686 may comprise a slight bevel 686-1 to facilitate entry of cartridges (e.g., bullet-ends thereof) into the chamber 684. As a semi-automatic firearm bolt (particularly a standard bolt having a planar breech-mating surface) engages with the planar portion of the breech surface 686, the slight bevel 686-1, while potentially decreasing cartridge feeding jams, actually increases the chance of firearm system failure as it creates a gap (not shown in FIG. 6) between the side walls of a cartridge seated in the chamber 684 and the walls of the barrel 680.

Figure 7:
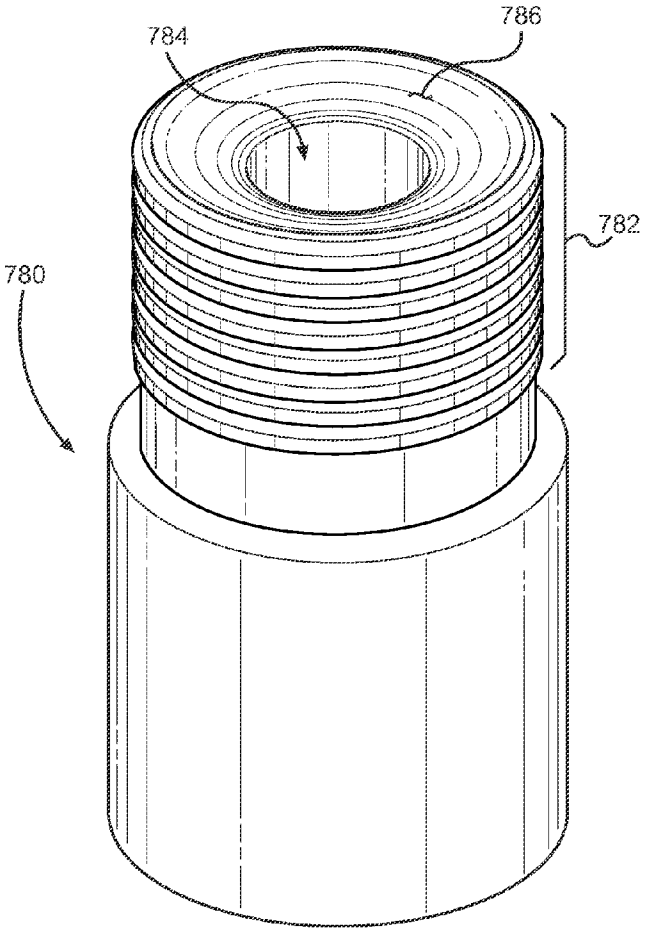
FIG. 7 is a perspective breech-end diagram of a cone-breech firearm barrel according to some embodiments.

Turning to FIG. 7, a perspective breech-end diagram of a cone-breech firearm barrel 780 according to some embodiments is shown. The cone-breech firearm barrel 780 may, for example, comprise a threaded portion 782 configured to rotatably couple to a barrel extension device (not shown in FIG. 7—e.g., the barrel extension device 470 of FIG. 4A, FIG. 4B, FIG. 4C, and FIG. 4D), a chamber 784 configured to accept a firearm cartridge (or portion thereof; not shown in FIG. 7; e.g., the firearm cartridge 808 of FIG. 8), and/or a fully-tapered or beveled cone-shaped breech surface 786. The breech surface 786 may generally be configured as a cone-shaped surface configured to engage with a corresponding tapered, beveled, and/or cone-shaped surface of a semi-automatic firearm bolt (not shown in FIG. 7; e.g., the firearm bolt 210 of FIG. 2A, FIG. 2B, FIG. 2C, and FIG. 2D and/or the firearm bolt assembly 300 of FIG. 3A, FIG. 3B, and FIG. 3C; e.g., thereby sealing a cartridge in the chamber 784). In some embodiments, the cone-shaped breech surface 786 permits a substantially increased contact area between an engaged firearm bolt and the cone-breech firearm barrel 780. The corresponding tapers and/or cone-shapes also create uninterrupted and/or uniform support for the side walls of a chambered cartridge—thereby greatly decreasing the likelihood of firearm system failure.

According to some embodiments, any or all of the components 782, 784, 786 of the cone-breech firearm barrel 780 may be similar in configuration and/or functionality to any similarly named and/or numbered components described herein. Fewer or more components 782, 784, 786 (and/or portions thereof) and/or various configurations of the components 782, 784, 786 may be included in the cone-breech firearm barrel 780 without deviating from the scope of embodiments described herein. In some embodiments, one or more of the various components 782, 784, 786 may not be needed and/or desired in the cone-breech firearm barrel 780.

Figure 8:
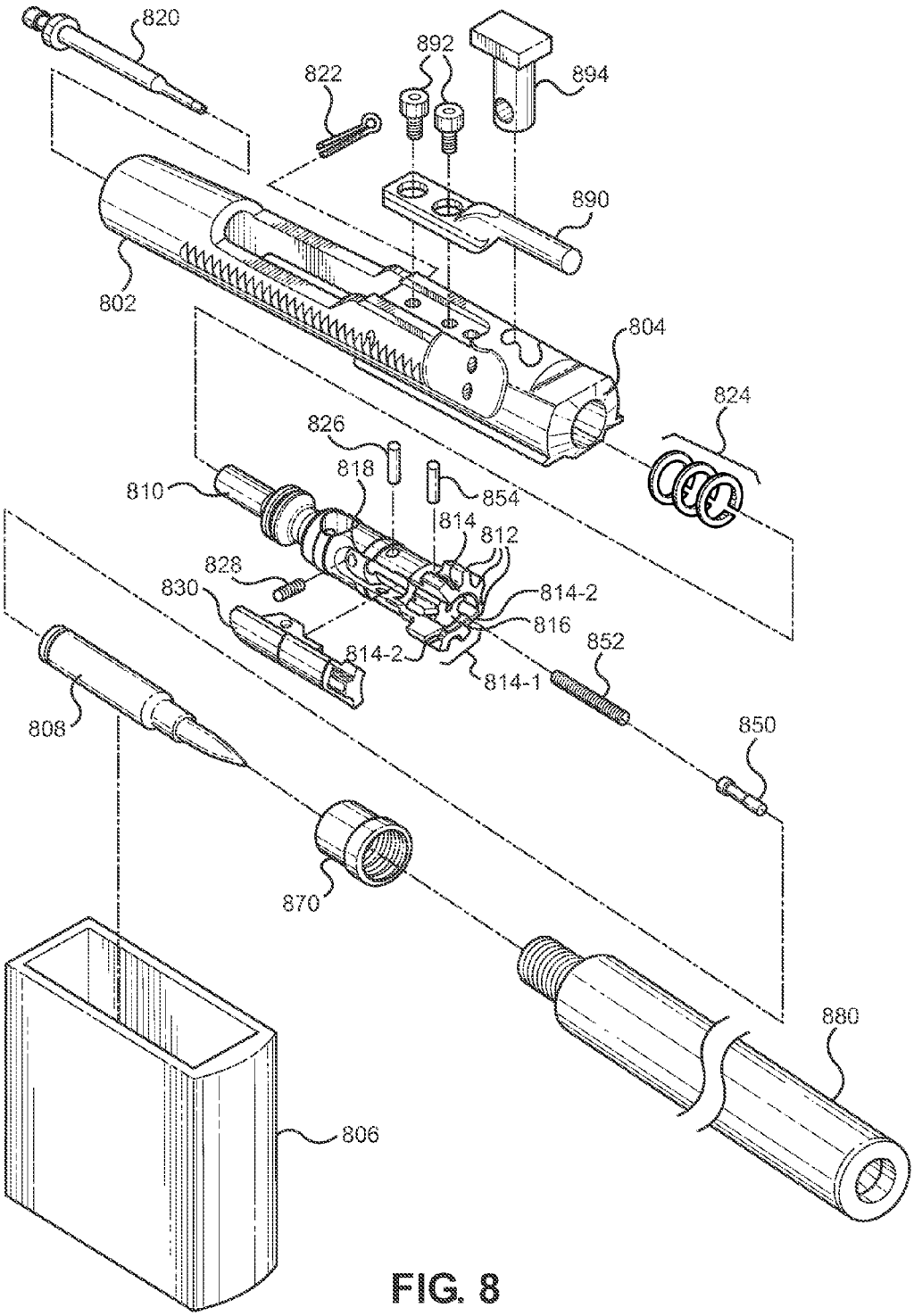
FIG. 8 is a perspective assembly diagram of a firearm system according to some embodiments.

Turning now to FIG. 8, a perspective assembly diagram of a firearm system 800 according to some embodiments is shown. As depicted for purposes of non-limiting illustration herein, the firearm system 800 comprises a bolt carrier 802 comprising a tapered barrel face 804, a magazine 806, an ammunition cartridge 808, a cone-shaped semi-automatic firearm bolt 810 (e.g., comprising seven (7) or eight (8) locking lugs 812, a cone-shaped breech face 814, a cartridge channel 814-1, cartridge guide fillets 814-2, a cartridge seat 816, and/or an extractor seat 818). In some embodiments, the firearm system 800 may comprise a firing pin 820, a firing pin retainer 822, one or more bolt rings 824, an extractor pin 826, and/or an extractor spring 828. In some embodiments, the extractor pin 826 may be coupled to retain and/or the extractor spring 828 may be coupled to act upon, an extractor 830.

According to some embodiments, the extractor 830 may comprise a wide-flanged extractor and/or the bolt 810 may comprise a wide-flanged extractor channel, seat, and/or cut or cavity (not explicitly detailed in FIG. 8). In some embodiments, the extractor 830 may be configured with a lug sleeve 848 and/or may comprise a narrow-neck configuration such that the bolt 810 may comprise eight (8) locking lugs 812. In some embodiments, the firearm system 800 may comprise a plunger-style ejector 850, an ejector spring 852, and/or an ejector retaining pin 854. In some embodiments, the firearm system 800 may comprise a barrel extension device 870 and/or a barrel 880. According to some embodiments, the firearm system 800 may comprise a bolt carrier key 890, one or more bolt carrier key retaining screws 892, and/or a cam pin 894.

According to some embodiments, any or all of the components 802, 804, 806, 808, 810, 812, 814, 814-1, 814-2, 816, 818, 820, 822, 824, 826, 828, 830, 850, 852, 854, 870, 880, 890, 892, 894 of the firearm system 800 may be similar in configuration and/or functionality to any similarly named and/or numbered components described herein. Fewer or more components 802, 804, 806, 808, 810, 812, 814, 814-1, 814-2, 816, 818, 820, 822, 824, 826, 828, 830, 850, 852, 854, 870, 880, 890, 892, 894 (and/or portions thereof) and/or various configurations of the components 802, 804, 806, 808, 810, 812, 814, 814-1, 814-2, 816, 818, 820, 822, 824, 826, 828, 830, 850, 852, 854, 870, 880, 890, 892, 894 may be included in the firearm system 800 without deviating from the scope of embodiments described herein. In some embodiments, one or more of the various components 802, 804, 806, 808, 810, 812, 814, 814-1, 814-2, 816, 818, 820, 822, 824, 826, 828, 830, 850, 852, 854, 870, 880, 890, 892, 894 may not be needed and/or desired in the firearm system 800.

While the firearm system 800 described with respect to FIG. 8 herein is generally illustrated as a semi-automatic rifle, many other types of firearms and/or firearm systems may benefit from the utilization of the specially-designed firearm components such as (i) an eight (8)-lug extractor design (either with an eighth ($8^{th}$) lug sleeve or a narrow-neck design), (ii) an extractor configured with angled sidewalls, (iii) a firearm bolt comprising a cartridge guide with guide fillets (e.g., in bolt-action and/or semi-automatic firearm systems), (iv) a seven (7) or eight (8) lug semi-automatic bolt comprising a tapered breech face, (v) a semi-automatic firearm bolt comprising a smooth barrel extension mating portion, (vi) a barrel extension comprising rounded lug channels and/or one or more bolt carrier component cuts, and/or (vii) a bolt carrier comprising a tapered barrel face, all as described in accordance with embodiments herein. Such components (or portions or combinations thereof) may, in accordance with some embodiments, for example, be utilized in and/or with pistols, rifles, shotguns, cannons, artillery, and/or firearm types whether having bolt-actions, repeating actions, semi-automatic actions, and/or automatic actions. Similar, while the term "cartridge" has been utilized herein to refer to ammunition and/or ammunition casings utilized in a firearm system, any ammunition and/or ammunition casing type that is or becomes known is contemplated in some embodiments, despite the terminology utilized to describe such ammunition and/or ammunition casing types (e.g., artillery "shells").

In some embodiments, a semi-automatic firearm cartridge extractor, may comprise angled sides configured to seat between two locking lugs of a semi-automatic firearm bolt. According to some embodiments, the semi-automatic firearm cartridge extractor may comprise a narrow neck configured to fit between the two locking lugs of the semi-automatic firearm bolt, wherein the two locking lugs comprise adjacent locking lugs. In some embodiments, the semi-automatic firearm bolt may comprise eight locking lugs and/or may comprise a locking lug sleeve defining a passage configured to accept an eighth locking lug of the eight-lug semi-automatic firearm bolt. According to some embodiments, the semi-automatic firearm cartridge extractor may comprise a first portion having a first width and configured to be seated in an extractor channel of a firearm bolt and/or a second portion comprising a flange configured to retain a rim of an ammunition cartridge, the second portion having a second width that is wider than the first width. According to some embodiments, the semi-automatic firearm cartridge may comprise a third portion configured to accept a spring force. According to some embodiments, the third portion may be disposed proximate to a first end of the first portion in the extractor channel. According to some embodiments, the second portion may be disposed proximate to a second end of the first portion, the second end being distal from the first end. According to some embodiments, the second end may be proximate to a mouth of the extractor channel at a face of the firearm bolt. According to some embodiments, the second portion may be beveled to match an angle of a taper of the face of the firearm bolt. According to some embodiments, the semi-automatic firearm cartridge extractor may comprise a fourth portion configured to accept a pin inserted into the firearm bolt. According to some embodiments, the second width may be between one and a half and two times as wide as the first width. According to some embodiments, a wide-flanged semi-automatic firearm cartridge extractor comprises a modified AR-15/M-16-style extractor.

In some embodiments, a barrel extension device may comprise a first end configured to accept a cone-breech semi-automatic firearm bolt carrier, the first end comprising a tapered face, a second end configured to mate with a barrel, and/or a plurality of locking lug channels configured to accept locking lugs of a semi-automatic firearm bolt via the first end, the locking lug channels defining a plurality of respective channel peaks there between, and wherein the locking lug channels are chamfered and wherein the channel peaks are rounded. According to some embodiments, the barrel extension device may comprise at least one bolt carrier chamfer disposed near the first end. According to some embodiments, the barrel extension device may comprise a locator hole disposed near the second end. In some embodiments, the second end may be configured to mate with the barrel utilizing a threaded portion. According to some embodiments, the barrel extension device may comprise at least one cartridge feed ramp disposed in the tapered face of the first end. According to some embodiments, the barrel extension device may comprise a magazine cut. In some embodiments, at least one of the plurality of respective channel peaks comprises a shortened peak.

According to some embodiments, a semi-automatic firearm system may comprise a receiver assembly defining a cavity, a bolt carrier coupled to the receiver assembly, the bolt carrier being configured to slide within the cavity, an ammunition magazine coupled to the receiver assembly, an ammunition cartridge disposed within the ammunition magazine, and a semi-automatic bolt rotatably and removably coupled to the bolt carrier, the semi-automatic bolt comprising (i) a tapered engaging end configured to mate with a cone-breech and (ii) a plurality of locking lugs, and the semi-automatic bolt being configured to receive the ammunition cartridge from the ammunition magazine via a cartridge guide channel defined by the tapered engaging end. In some embodiments, the semi-automatic bolt comprises a plurality of cartridge channel fillets disposed within the cartridge guide channel. In some embodiments, the semi-automatic bolt comprises a cartridge seat in which the ammunition cartridge is received and seated. According to some embodiments, the semi-automatic firearm system may comprise a plunger-style ejector disposed within the cartridge seat. According to some embodiments, the semi-automatic firearm system may comprise an ejector spring coupled to exert a spring force on the plunger-style ejector. According to some embodiments, the semi-automatic firearm system may comprise a cartridge extractor disposed within an extractor channel of the semi-automatic bolt, the cartridge extractor comprising a locking lug sleeve configured to accept one of the plurality of locking lugs of the semi-automatic bolt. According to some embodiments, the semi-automatic firearm system may comprise a cartridge extractor disposed within an extractor channel of the semi-automatic bolt, the cartridge extractor comprising angled sides configured to seat between two of the plurality of locking lugs of the semi-automatic bolt. According to some embodiments, the semi-automatic firearm system may comprise a cartridge extractor disposed within an extractor channel of the semi-automatic bolt, the cartridge extractor comprising a thin neck configured to seat between two of the plurality of locking lugs of the semi-automatic bolt. According to some embodiments, the semi-automatic firearm system may comprise a wide-flanged cartridge extractor disposed within an extractor channel of the semi-automatic bolt. In some embodiments, the wide-flanged cartridge extractor comprises a modified AR-15/M-16-style extractor. According to some embodiments, the semi-automatic firearm system may comprise a concave cone-shaped barrel extension device comprising chamfered locking lug channels, the barrel extension device coupled to receive the bolt carrier and the semi-automatic bolt. According to some embodiments, the semi-automatic firearm system may comprise a barrel coupled to the barrel extension device. In some embodiments, the plurality of locking lugs comprises seven locking lugs. In some embodiments, the plurality of locking lugs comprises eight locking lugs.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicant currently intends to file additional applications to pursue patents for subject matter that has been disclosed and enabled but not claimed in the present application.

What is claimed is:

1. A barrel extension for a semi-automatic firearm system, comprising:

a cylindrically-shaped barrel extension body defining an interior passage and comprising a first end and a second end, the first end comprising a concave bolt engaging face and the second end comprising threads for mating with corresponding threads of a firearm barrel wherein the concave bolt engaging face comprises a fully concave forcing cone;

seven locking lug channels disposed in the concave bolt engaging face and spaced at even radial intervals and extending axially into the interior passage, each one of the seven locking lug channels being chamfered at the apex; and seven locking lug channel peaks defined between adjacent pairs of the seven locking lug channels, five of the seven locking lug channel peaks being rounded at the peak, wherein the five of the seven locking lug channel peaks extend radially inward by a first distance and wherein a sixth and a seventh one of the seven locking lug channel peaks extends radially inward by a second distance that is shorter than the first distance.

2. The barrel extension of claim 1, further comprising:

a first cartridge feed ramp disposed in the concave bolt engaging face at the radial position of a first one of the seven locking lug channels, thereby recessing an entrance of the first one of the seven locking lug channels deeper into the concave bolt engaging face than at least one adjacent locking lug channel.

3. The barrel extension of claim 2, further comprising:

a second cartridge feed ramp disposed in the concave bolt engaging face at the radial position of a second one of the seven locking lug channels, thereby recessing an entrance of the second one of the seven locking lug channels deeper into the concave bolt engaging face than at least one adjacent locking lug channel.

4. The barrel extension of claim 3, wherein the first and second cartridge feed ramps cause a recessing of the entrances of the first and second ones of the seven locking lug channels deeper into the concave bolt engaging face than the other five locking lug channels.

5. The barrel extension of claim 3, wherein the first and second ones of the seven locking lug channels comprise adjacent locking lug channels.

6. The barrel extension of claim 1, further comprising:

a chamfered portion of the cylindrically-shaped barrel extension body at the first end, the chamfered portion aligning axially with one of the seven locking lug channel peaks.

7. The barrel extension of claim 1, further comprising:

a chamfered portion of the cylindrically-shaped barrel extension body at the first end, the chamfered portion aligning axially with one of the seven locking lug channels.

8. The barrel extension of claim 1, further comprising:

a locator hole bored radially inward through the cylindrically-shaped barrel extension body at the second end and extending into the interior passage.

9. The barrel extension of claim 8, wherein the threads comprise interior threads disposed in a threaded portion of the interior passage and wherein the locator hole extends through the interior threaded portion.

10. The barrel extension of claim 1, further comprising:

an eighth locking lug channel disposed in the concave bolt engaging face and spaced at even radial intervals with the other seven locking lug channels and extending axially into the interior passage, the eighth locking lug channel being chamfered at the apex.

11. The barrel extension of claim 10, further comprising:

an eighth locking lug channel peak defined between an adjacent pair of the eight locking lug channels.

12. A barrel extension device for a semi-automatic firearm system, comprising:

a cylindrically-shaped barrel extension body defining an interior passage and comprising a first end and a second end, the first end comprising a concave engaging face for mating with a cone-shaped breech block and the second end comprising threads for mating with corresponding threads of a firearm barrel;

seven locking lug channels disposed in the concave bolt engaging face and spaced at even radial intervals and extending axially into the interior passage, each one of the seven locking lug channels being chamfered at the apex; and seven extension lugs defined between adjacent pairs of the seven locking lug channels, five of the seven extension lugs being rounded at the peak, wherein the five of the seven extension lugs extend radially inward by a first distance and wherein a sixth and a seventh one of the seven extension lugs extend radially inward by a second distance that is shorter than the first distance.

13. The barrel extension device of claim 12, wherein the concave engaging face is defined by a single taper extending from an outside diameter of the concave engaging face to the peaks of the extension lugs.

14. The barrel extension device of claim 12, wherein the cylindrically-shaped barrel extension body comprises, at the first end and on an outside surface thereof, a chamfered portion aligning axially with one of the seven extension lugs.

15. The barrel extension device of claim 12, wherein the cylindrically-shaped barrel extension body comprises, at the first end and on an outside surface thereof, a chamfered portion aligning axially with one of the seven locking lug channels.

16. A barrel extension device for a semi-automatic firearm system, comprising:

a cylindrically-shaped barrel extension body defining an interior passage and comprising a first end and a second end, the first end comprising (i) a fully concave engaging face for mating with a cone-shaped breech block and (ii) two cartridge feed ramps recessed into the fully concave engaging face, the plurality of cartridge feed ramps defining an interruption in a taper of the fully concave engaging face, and the second end comprising threads for mating with corresponding threads of a firearm barrel;

seven locking lug channels disposed in the fully concave bolt engaging face and spaced at even radial intervals and extending axially into the interior passage, each one of the seven locking lug channels being chamfered at the apex; and seven extension lugs defined between adjacent pairs of the seven locking lug channels, five of the seven extension lugs being rounded at the peak.

17. The barrel extension device of claim 16, wherein, other than at the interruption in the taper due to the cartridge feed ramps, the concave engaging face is defined by a single taper extending from an outside diameter of the concave engaging face to the peaks of the extension lugs.

18. The barrel extension device of claim 16, wherein the five of the seven extension lugs extend radially inward by a first distance and wherein a sixth and a seventh one of the seven extension lugs extend radially inward by a second distance that is shorter than the first distance.

19. The barrel extension device of claim 16, wherein the cylindrically-shaped barrel extension body comprises, at the first end and on an outside surface thereof, a chamfered portion aligning axially with one of the seven extension lugs.

20. The barrel extension device of claim 16, wherein the cylindrically-shaped barrel extension body comprises, at the first end and on an outside surface thereof, a chamfered portion aligning axially with one of the seven locking lug channels.

* * * * *